US009044091B2

(12) United States Patent
Walker et al.

(10) Patent No.: US 9,044,091 B2
(45) Date of Patent: Jun. 2, 2015

(54) AQUATIC FURNITURE

(75) Inventors: Jennifer Walker, Austin, TX (US); Damon Chavez, Austin, TX (US); Michael Sykes, Austin, TX (US)

(73) Assignee: Pure Liquid Pool Products, LLC, Austin, TX (US)

( * ) Notice: Subject to any disclaimer, the term of this patent is extended or adjusted under 35 U.S.C. 154(b) by 0 days.

(21) Appl. No.: 13/994,232

(22) PCT Filed: Dec. 21, 2011

(86) PCT No.: PCT/US2011/066464
§ 371 (c)(1), (2), (4) Date: Sep. 2, 2013

(87) PCT Pub. No.: WO2012/088263
PCT Pub. Date: Jun. 28, 2012

(65) Prior Publication Data

US 2013/0341988 A1 Dec. 26, 2013

Related U.S. Application Data

(60) Provisional application No. 61/426,283, filed on Dec. 22, 2010.

(51) Int. Cl.

| | |
|---|---|
| ***A47C 9/00*** | (2006.01) |
| ***E04H 4/14*** | (2006.01) |
| ***A47K 3/12*** | (2006.01) |
| ***A47C 7/02*** | (2006.01) |
| ***A47C 9/10*** | (2006.01) |

(Continued)

(52) U.S. Cl.
CPC .. *A47C 9/00* (2013.01); *E04H 4/14* (2013.01); *A47K 3/122* (2013.01); *A47C 7/02* (2013.01); *A47C 9/10* (2013.01); *A47C 15/004* (2013.01); *A47B 37/04* (2013.01); *A47C 9/007* (2013.01); *A47B 13/16* (2013.01); *A47C 7/503* (2013.01)

(58) Field of Classification Search
CPC ..... A47K 3/122; E04H 4/14; A47C 7/02; A47C 7/503; A47C 5/12; A47C 9/007; A47C 15/004; A47C 9/00; A47C 9/10; A47B 13/16; A47B 37/04
USPC ..... 297/452.46, 462, 461, 423.41, 423.17, 297/423.1, 452.65; 4/578.1, 590, 496; D6/349
See application file for complete search history.

(56) References Cited

U.S. PATENT DOCUMENTS

| | | | | |
|---|---|---|---|---|
| 89,779 | A * | 5/1869 | MacFerran | 297/188.09 |
| 3,669,494 | A * | 6/1972 | Lohmeyer | 297/440.14 |

(Continued)

OTHER PUBLICATIONS

Authorized Officer Simin Baharlou, PCT International Preliminary Report on Patentability for International Application No. PCT/US2011/066464 mailed Jul. 4, 2013, 6 pages.

(Continued)

*Primary Examiner* — Milton Nelson, Jr.
(74) *Attorney, Agent, or Firm* — Fish & Richardson P.C.

(57) ABSTRACT

A seating device for use in a liquid, the seating device including a body having a closed first end, an open second end and a wall running between the closed first end and the open second end, the closed first end and the wall defining a cavity that is accessible through the open second end, the closed first end defining a seating surface having one or more holes formed therethrough, the one or more holes enabling flow of a fluid therethrough as the seating device is submerged in the liquid.

8 Claims, 11 Drawing Sheets

(51) Int. Cl.

| | |
|---|---|
| ***A47C 15/00*** | (2006.01) |
| ***A47B 13/16*** | (2006.01) |
| ***A47C 7/50*** | (2006.01) |
| *A47B 37/04* | (2006.01) |

(56) References Cited

U.S. PATENT DOCUMENTS

| | | | | |
|---|---|---|---|---|
| 4,109,960 | A * | 8/1978 | Stinchfield | 297/271.5 |
| 4,208,072 | A | 6/1980 | Iskendarian | |
| 4,950,033 | A * | 8/1990 | Anderson | 297/461 |
| 5,441,433 | A | 8/1995 | Stanley | |
| 5,505,645 | A | 4/1996 | Engler, Jr. | |
| 5,640,723 | A * | 6/1997 | Stanek | 4/578.1 |
| 5,749,555 | A * | 5/1998 | Albrecht | 248/346.01 |
| 5,823,121 | A | 10/1998 | Reiter | |
| 6,036,563 | A * | 3/2000 | Walker | 441/130 |
| 6,171,160 | B1 | 1/2001 | Skaggs et al. | |
| 6,209,147 | B1 | 4/2001 | Wheaton | |
| D468,116 | S | 1/2003 | Champion | |
| 6,808,434 | B1 | 10/2004 | Park | |
| 6,878,026 | B2 | 4/2005 | Cloutier | |
| 7,261,377 | B2 * | 8/2007 | Ehud | 297/283.1 |
| 7,293,840 | B1 * | 11/2007 | Schu | 297/451.13 |
| 7,300,104 | B1 | 11/2007 | Hagedorn | |
| D575,540 | S | 8/2008 | Goldberg | |
| D589,269 | S * | 3/2009 | Allende | D6/349 |
| D594,737 | S | 6/2009 | Kelly | |
| D625,931 | S * | 10/2010 | Estrup | D6/349 |
| 7,971,286 | B2 * | 7/2011 | Dillen et al. | 4/496 |
| 8,057,272 | B1 * | 11/2011 | Wray et al. | 441/80 |
| D650,184 | S * | 12/2011 | Hsu | D6/349 |
| D671,757 | S * | 12/2012 | Walker et al. | D6/349 |
| 2004/0077235 | A1 | 4/2004 | Cloutier et al. | |
| 2007/0236060 | A1 | 10/2007 | Switzer | |
| 2010/0031437 | A1 | 2/2010 | Giroux et al. | |
| 2010/0248568 | A1 | 9/2010 | Brindle | |
| 2012/0054954 | A1 * | 3/2012 | Vandiver | 4/496 |
| 2012/0124733 | A1 * | 5/2012 | Roberts | 4/496 |

OTHER PUBLICATIONS

Authorized Officer Jin Soo Jung, PCT International Search Report and Written Opinion for International Application No. PCT/US2011/066464 mailed Aug. 22, 2012, 9 pages.

* cited by examiner

AQUATIC FURNITURE

CROSS-REFERENCE TO RELATED APPLICATION

This application is a National Stage application under 35 U.S.C. §371 of International Application No. PCT/US2011/066464, having an International Filing Date of Dec. 21, 2011, which claims the benefit of U.S. Provisional Application No. 61/426,283, filed Dec. 22, 2010. The disclosure of the foregoing application is hereby incorporated by reference in its entirety.

TECHNICAL FIELD

The present disclosure is directed to aquatic furniture including seating devices and tables.

SUMMARY

Implementations of the present disclosure are directed to a seating device for use in water. In some implementations, a seating device includes a body having a closed first end, an open second end and a wall running between the closed first end and the open second end, the closed first end and the wall defining a cavity that is accessible through the open second end, the closed first end defining a seating surface having one or more holes formed therethrough, the one or more holes enabling flow of a fluid therethrough as the seating device is submerged in the liquid.

In some implementations, the body includes first and second foot rests integrally formed therein, each of the first and second footrests including a surface for supporting a foot. In some implementations, the surface is a textured surface.

In some implementations, the wall includes a contoured surface, the contoured surface including a contour that accommodates human anatomical features. In some implementations, the human anatomical features include features associated with a human foot and/or ankle.

In some implementations, the seating device further includes a geometric center located half way between the closed first end and the open second end, and a center-of-gravity located between the geometric center and the open second end.

In some implementations, the body defines an end cavity disposed about a periphery of the closed second end. In some implementations, the seating device further includes a weighting material disposed within the end cavity. In some implementations, the weighting material includes stainless steel.

In some implementations, the seating surface is contoured.

In some implementations, the closed first end defines a first diameter and the open second end defines a second diameter, the first diameter being less than the second diameter.

The details of one or more implementations are set forth in the accompanying drawings and the description below. Other features and advantages will be apparent from the description and drawings, and from the claims.

DETAILED DESCRIPTION

Figure 1:
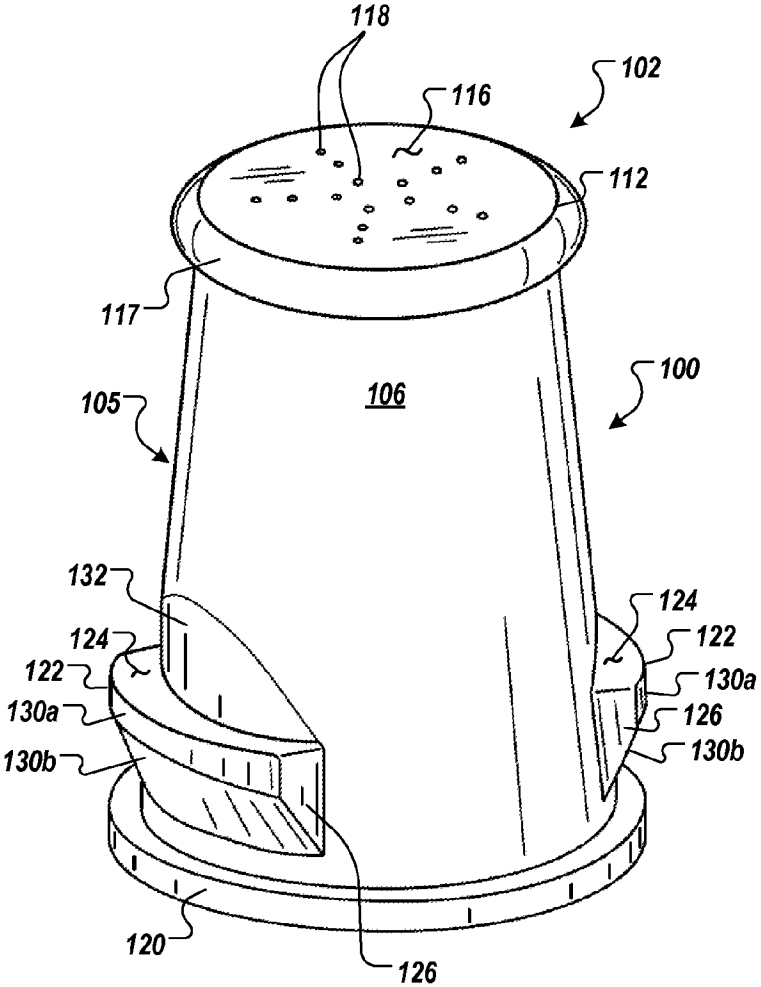
FIG. 1 is a perspective view of a seating device in accordance with implementations of the present disclosure.
Figure 3:
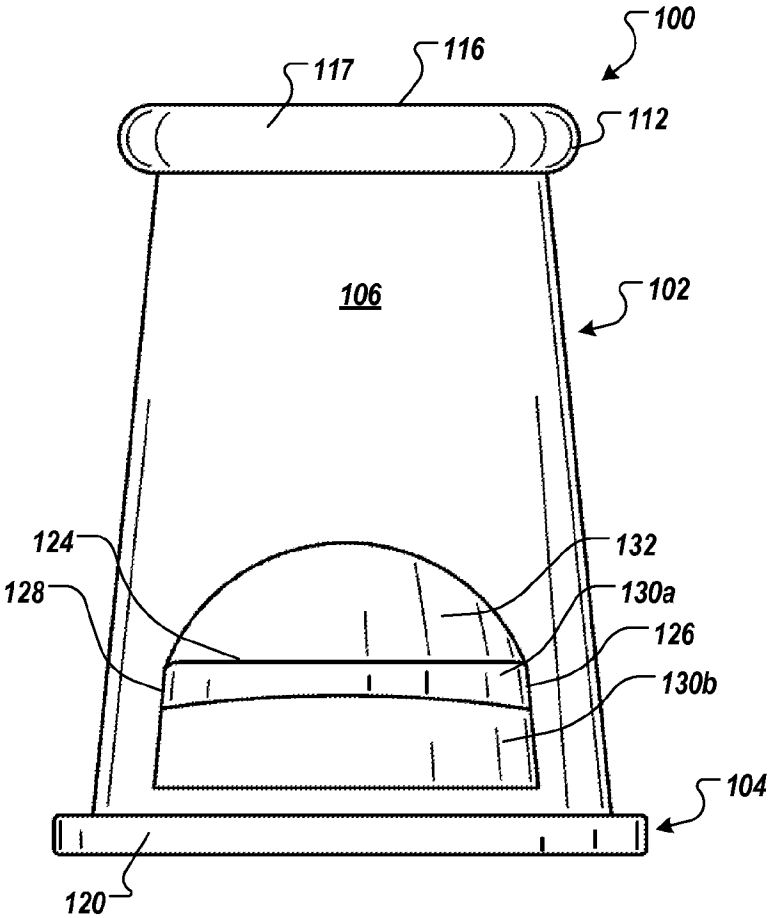
FIGS. 2 and 3 are side views of the seating device of FIG. 1.
Figure 2:
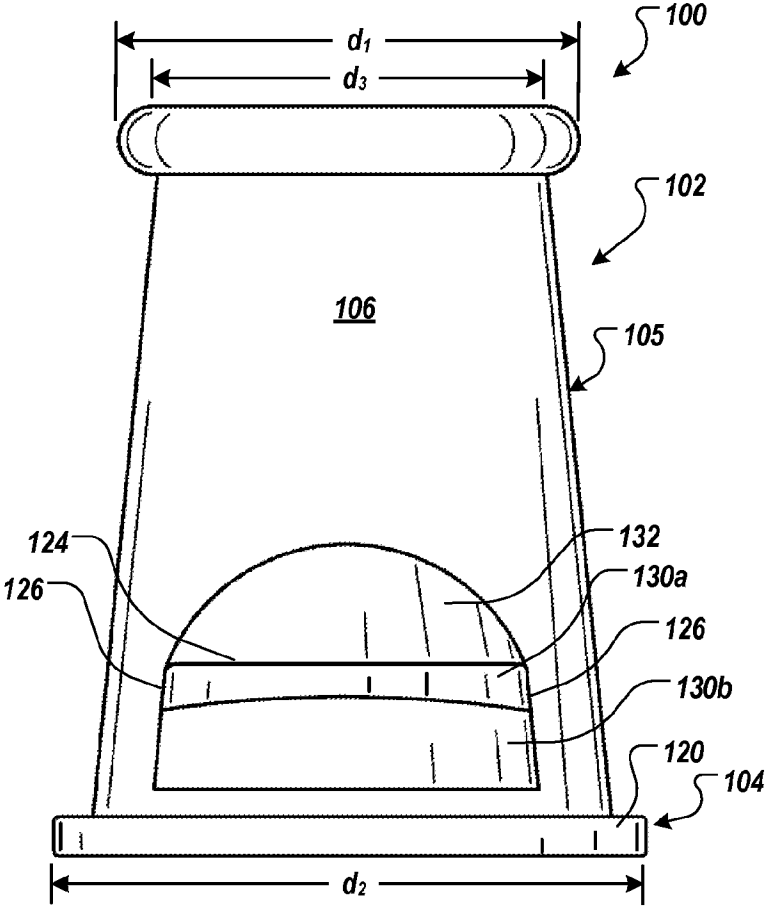
Figure 5:
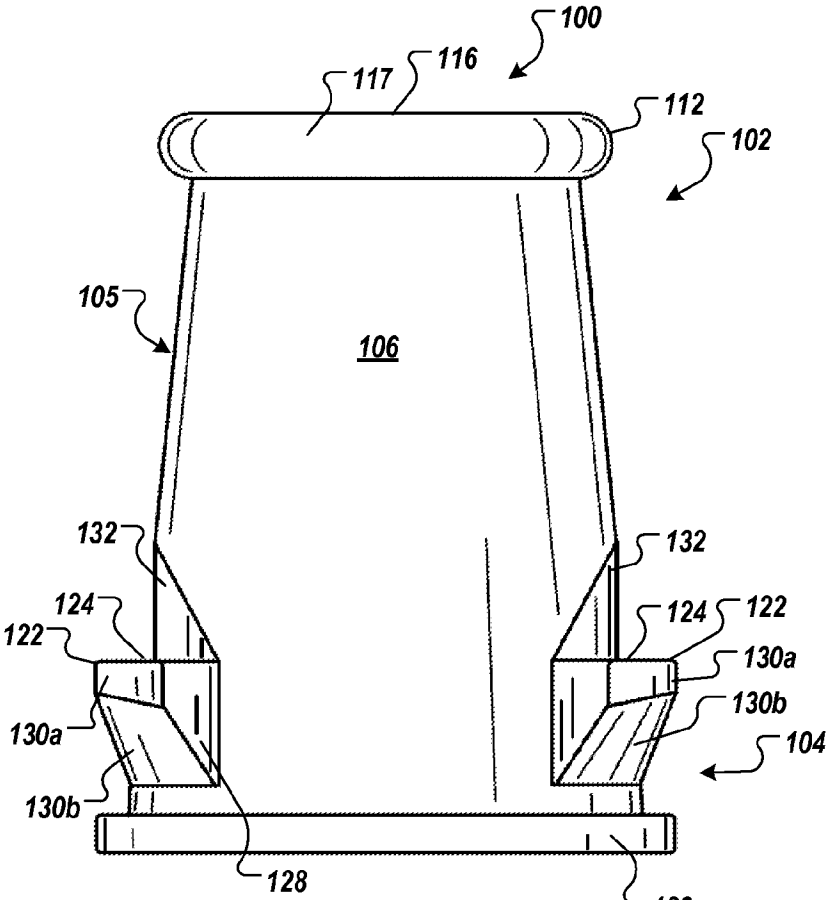
FIGS. 4 and 5 are front and back views of the seating device of FIG. 1.
Figure 4:
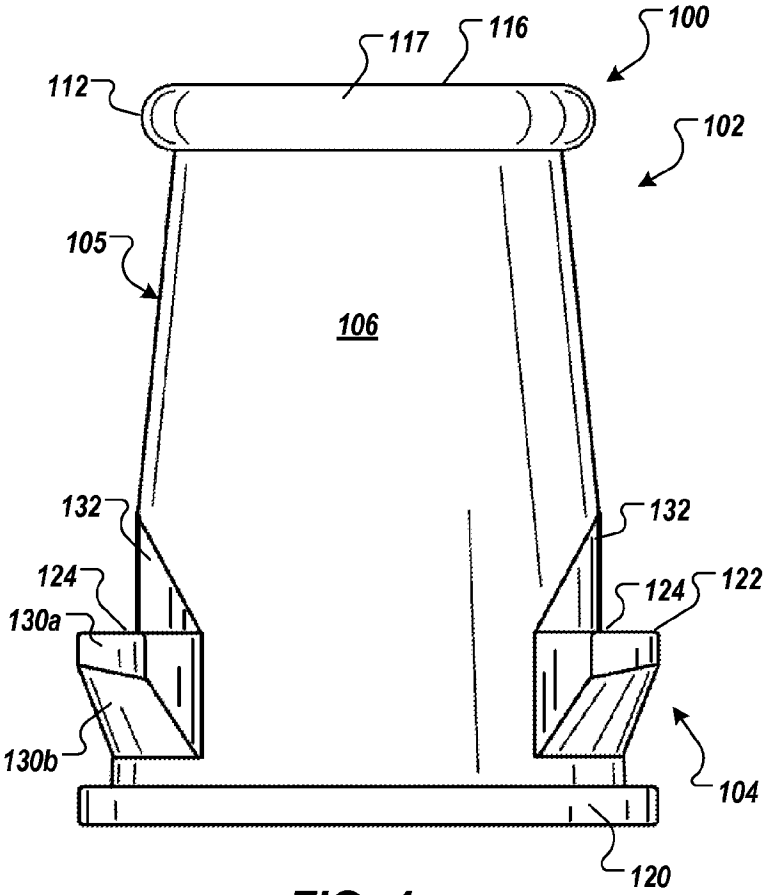
Figure 6B:
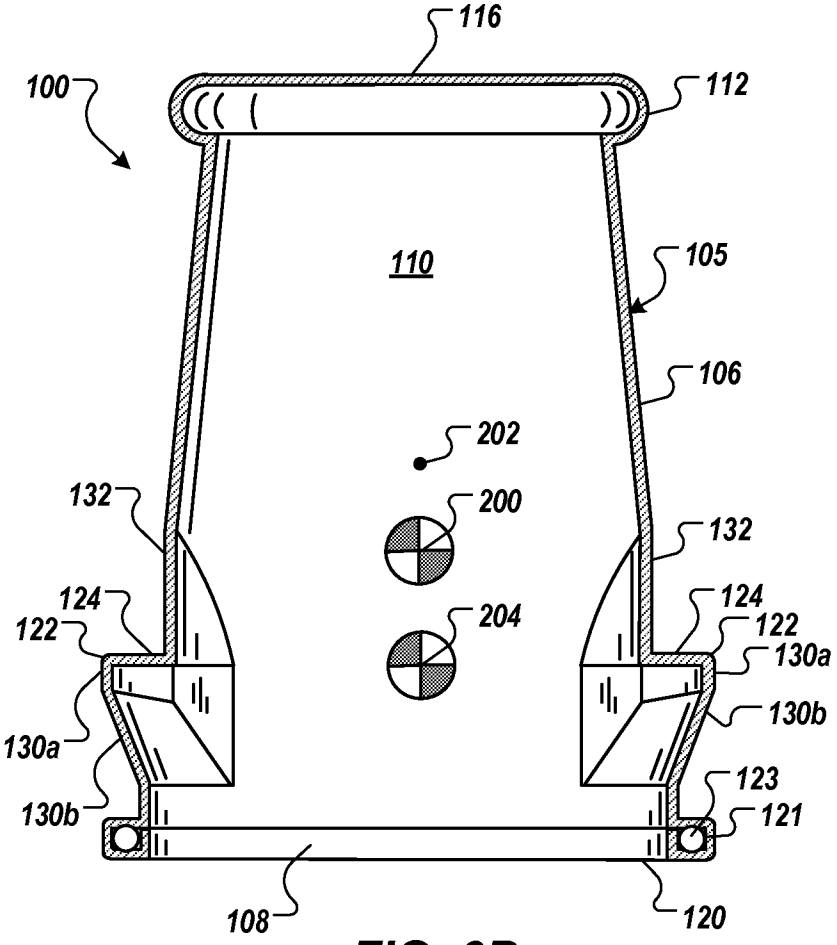
FIG. 6B is a cross-sectional view of the seating device taken along line 6B-6B of FIG. 6A.
Figure 6A:
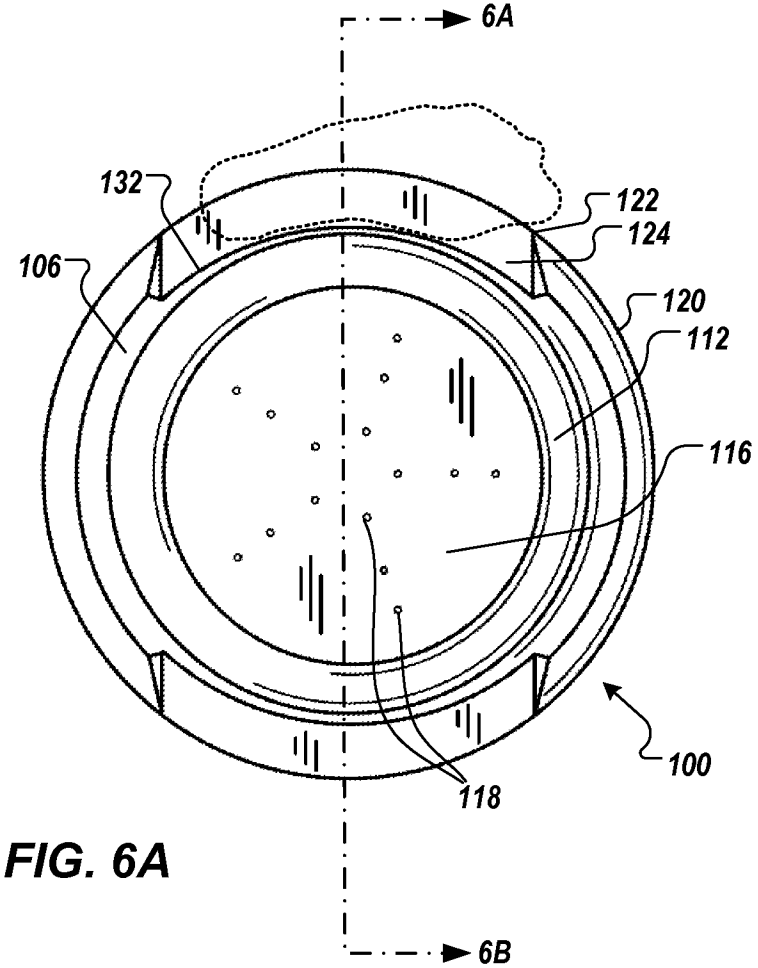
FIG. 6A is a top view of the seating device of FIG. 1.
Figure 7:
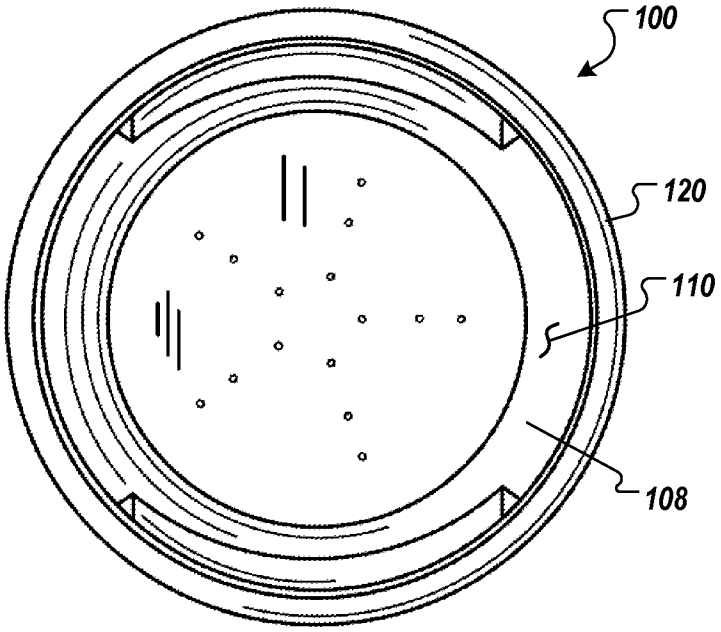
FIG. 7 is a bottom view of the seating device of FIG. 1.
Figure 8:
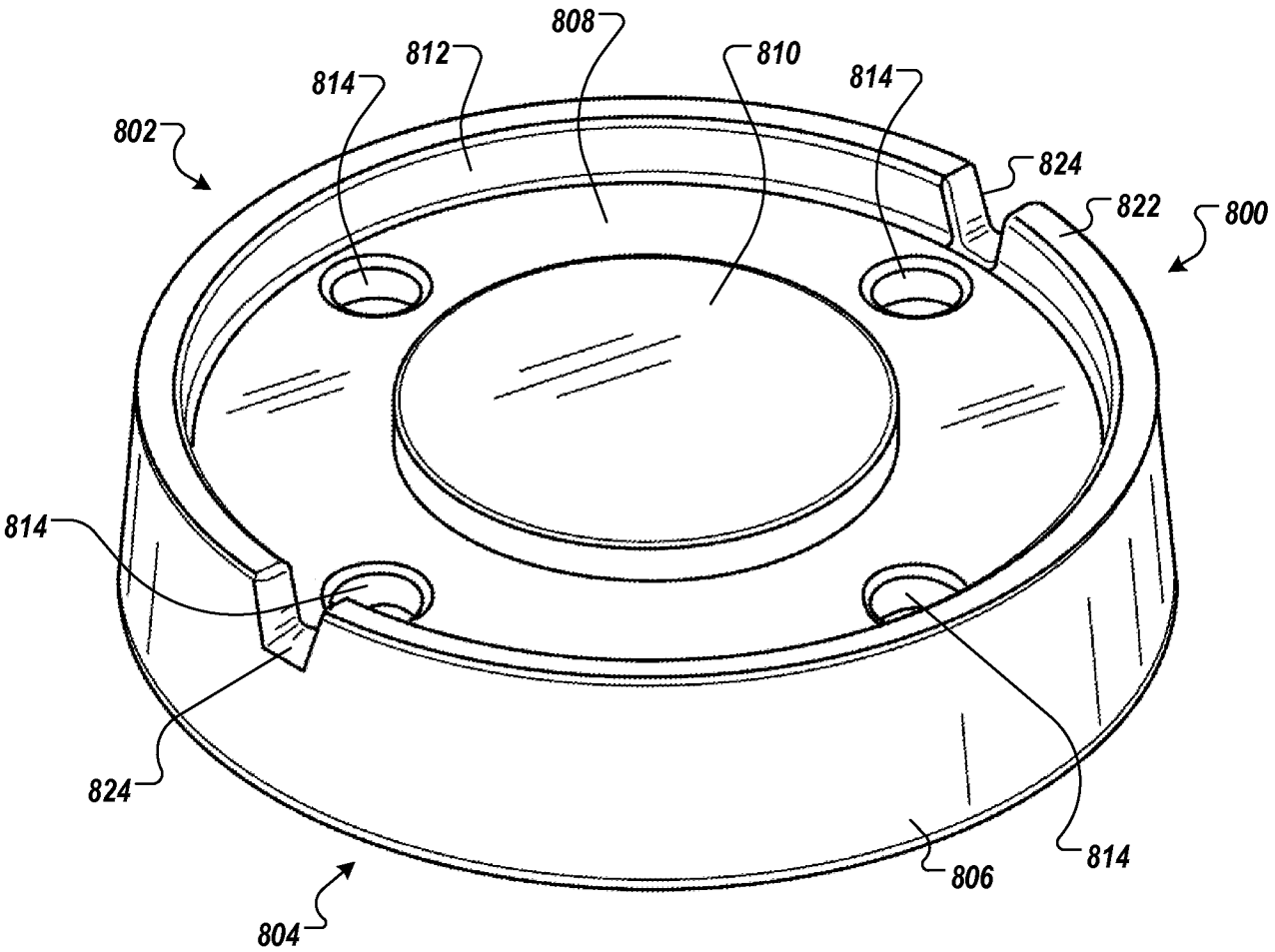
FIG. 8 is a perspective view of a table in accordance with implementations of the present disclosure.
Figure 9:
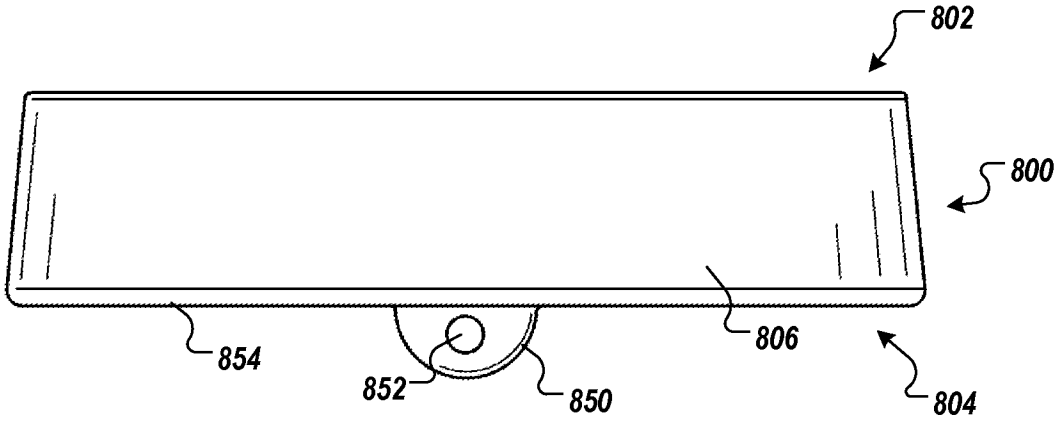
FIGS. 9 and 10 are side views of the table of FIG. 8.
Figure 10:
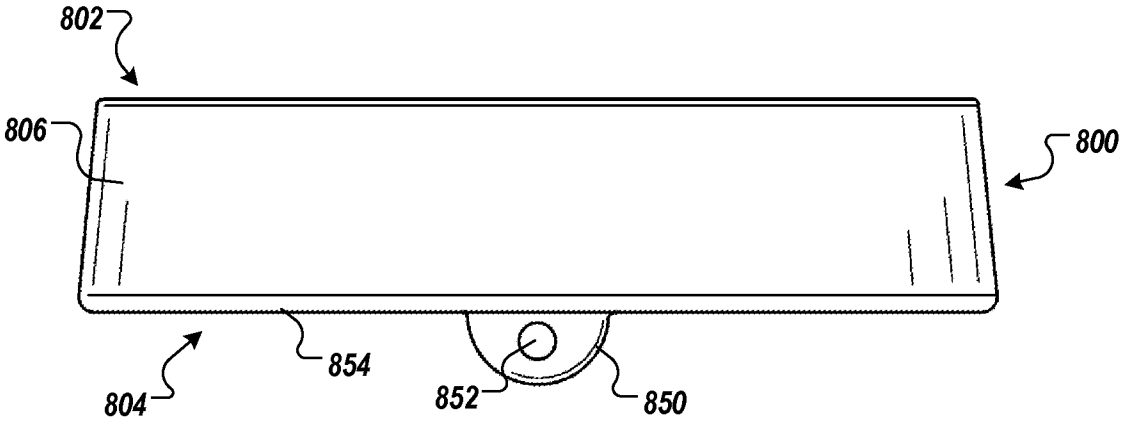
Figure 11:
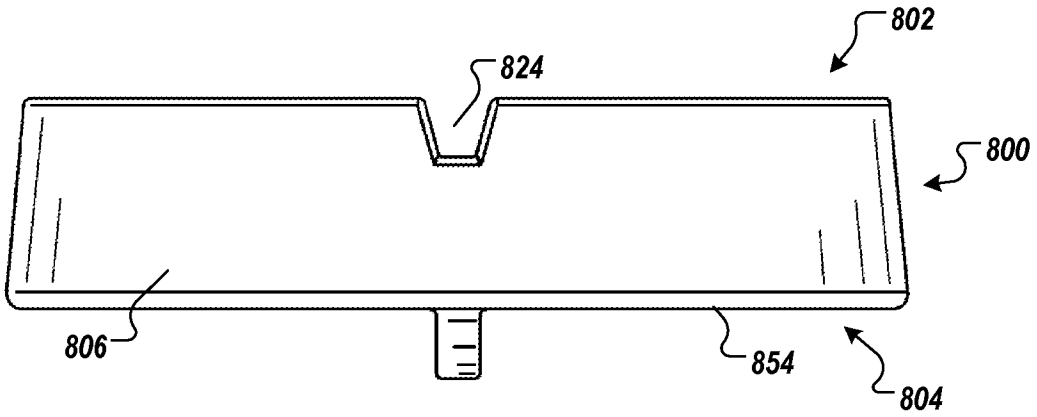
FIGS. 11 and 12 are front and back views of the table of FIG. 8.
Figure 12:
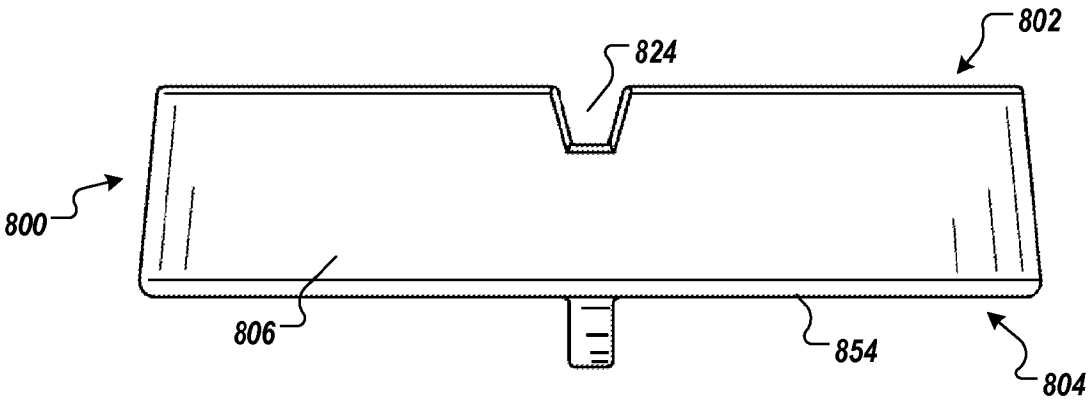
Figure 13:
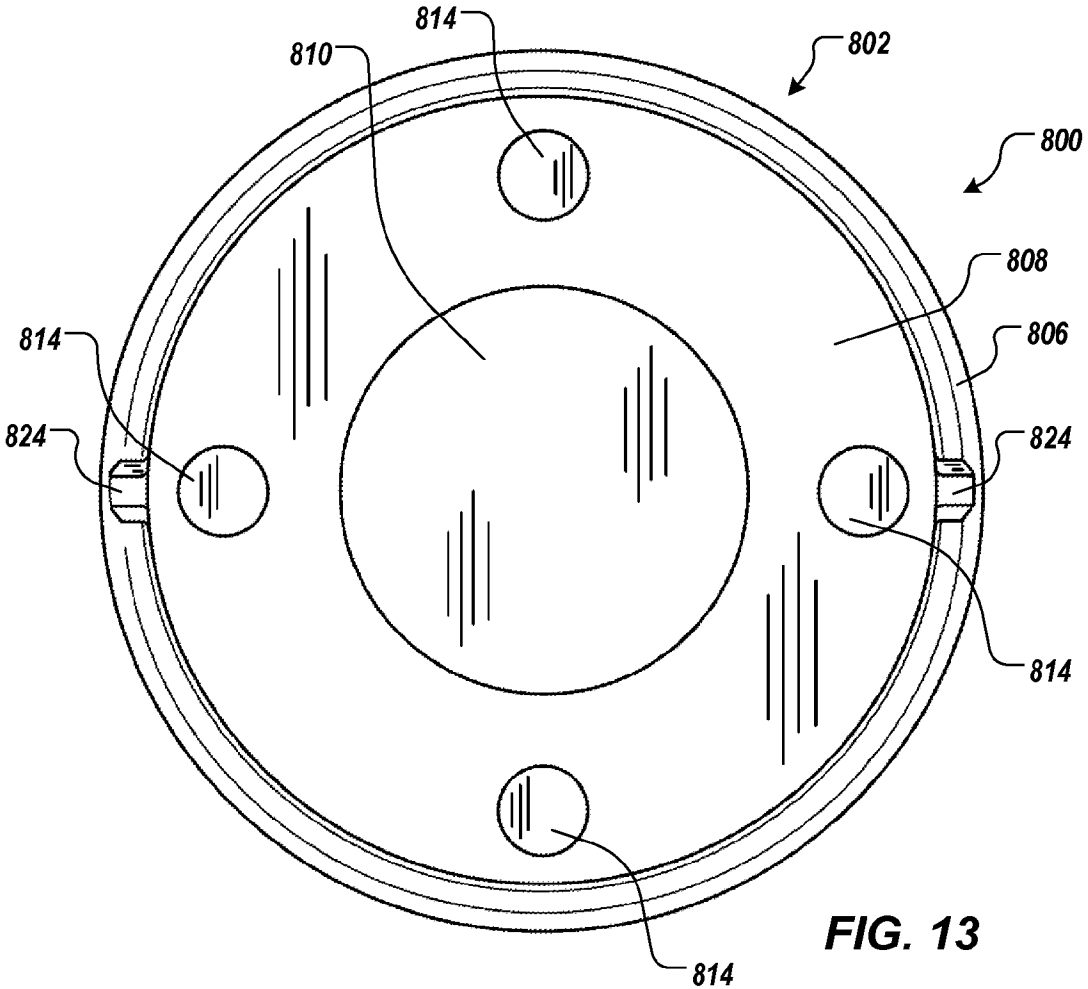
FIG. 13 is a top view of the table of FIG. 1.

Referring now to FIGS. 1-7, a seating device 100 will be described. The seating device 100 includes a first end 102 and a second end 104. The first end 102 is spaced apart from the second end 104 by a body 105. The body 105 includes a wall 106 that extends between the first end 102 and the second end 104. In some implementations, the wall 106, and thus the body 105, is generally of a conical shape, such that a diameter ($d_1$) of the first end 102 is less than a diameter ($d_2$) of the second end 104. The first end 102 is closed and the second end 104 is open. In some implementations, the second end 104 includes an opening 108 (FIGS. 6B and 7). The opening 108 may define any geometrical shape such as square, rectangular and circular, for example. In the illustrated implementation, the opening 108 is circular. The first end 102, the second end 104, and the wall 106 define a hollow cavity 110 within the seating device 100. The larger base (e.g., as achieved by the diameter ($d_2$) being larger than the diameter ($d_1$)) of the seating device reduces or otherwise inhibits any tendency for the seating device 100 to tip from an upright position (e.g., the first end 102 being the "top" end and the second end 104 being a "bottom" end relative to a vertical axis).

As noted above, the first end 102 is closed. The first end 102 includes a seat 112 having a seating surface 116. The seating surface 116, and thus the seat 112, may be of any geometrical shape such as square, rectangular and circular, for example. In the illustrated implementation, the seating surface 116 is circular and includes a diameter ($d_3$). The seat 112 further includes a wall 117. The wall 117 is connected to the wall 106 of the body 105. In the illustrated implementation, the wall 117 is convexly curved and defines the diameter ($d_1$). The curvature of the wall 117 provides a smooth transition between the seating surface 116 and the wall 117, without sharp, angular edges. In some implementations, the seating surface 116 is provided as a substantially flat surface. In some implementations, the seating surface 116 can be provided as a curved surface (e.g., a convex surface that curves outward from the cavity 110, or a concave surface that curves inward to the cavity 110). In some implementations, the seating surface 116 can include a complex geometric pattern that generally conforms to the anatomy of a seated user. In some implementations, the seating device 100 can include a seat back that extends above the seating surface 116. The seat back can provide back support to a seated user.

One or more holes 118 are formed through the seating surface 116. In the illustrated embodiment, a plurality of holes 118 is provided. The holes 118 define passages to the cavity 110. In this manner, and as discussed in further detail below, air is able to freely flow between the cavity 110 and a surrounding gaseous atmosphere through the holes 118. In cases where the seating device 100 is submerged in a liquid, the holes 118 enable the flow of liquid between the cavity 110 and a surrounding liquid environment.

In some implementations, the one or more holes 118 are symmetric about the seating surface 116. In implementations including a single hole 118, the hole 118 can be formed through a center of the seating surface 116. In implementations including multiple holes 118, the holes can be arranged in a geometric pattern. Example geometric patterns include star, square, rectangular, circular, triangular and the like. In the illustrated implementation, the holes 118 are arranged in a star pattern that is symmetric across the seating surface 116.

The second end 104 includes a base member 120. The base member 120 extends generally perpendicular from the wall 106 to define the diameter (d2), and forms a generally ring-shaped structure. In some implementations, the base member 120 includes a solid cross-section. The solid cross-section of the base member 120 enables the second end 104 to be relatively heavier than the first end 102. More specifically, the solid cross-section enables a center-of-mass 200 (FIG. 6B) of the seating device 100 to be located closer to the second end 104 than the first end 102, relative to a geometric center 202 of the seating device 100. In this manner, the seating device 100 includes a natural tendency to right itself (e.g., such that the first end 102 is the "top" end and the second end 104 is a "bottom" end relative to a vertical axis), and to reduce or otherwise inhibit any tendency for the seating device to tip.

In some implementations, the base member 120 includes a hollow cross-section, as illustrated in FIG. 6B, to provide a cavity 121. The cavity 121 can retain weighting material and/or a weighting member 123. The weighting material and/or weighting member 123 can define a center-of-mass 204 (FIG. 6B) of the seating device 100 as being even closer to the second end 104, further enhancing self-righting characteristics of the seating device 100, and further reducing or otherwise inhibiting any tendency for the seating device to tip. In some implementations, weighting materials can include sand, dirt, rocks or any other material that provides weight to the second end 104. In some implementations, a weighting member can include a ring made of a material (e.g., stainless steel) that provides weight to the second end 104. In some examples, a weighting member can include a cable (e.g., steel cable, wire rope) that has a corrosion-resistant coating (e.g., vinyl and/or nylon coated). In some implementations, the weighting material and/or weighting member 123 can be selectively removed from the cavity 123. In this manner, the seating device 100 can be made lighter (e.g., for shipping).

The wall 106 includes integrally formed protrusions 122 that are provided on opposite sides of the seating member 100. The protrusions 122 include a surface 124, side walls 126, 128, and perimeter walls 130*a*, 130*b*. Surface 132 are shaped in the wall 106 above each of the protrusions 122. In some implementations, the surface 124 is substantially parallel with a plane of the seating surface 116 of the seat 112. In some implementations, the surface 124 is sloped at an angle relative to a plane of the seating surface 116. In some implementations, the angle is such that the surface 124 slopes away from a plane of the seating surface 116 in an axial direction running away from the wall 106.

In some implementations, the protrusions 122 provide foot rests for a user seated on the seating device 100. In some implementations, the surface 124 can include an integrally formed pattern to improve traction with a sole of a seated user. In some implementations, a layer of tractive material (not shown) can be applied to the surface 124. The tractive material can provide traction with a sole of a seated user. In some implementations, the surface 124 is contoured to accommodate curvature of a sole of the human foot. For example, the surface 124 can be contoured to support an arch, ball and/or heel of the human foot.

The surfaces 132 include curved surfaces that generally conform to a curve of the wall 106. The surfaces 132 generally curves to accommodate an inside surface of the human foot, above an arch of the human foot (see FIG. 6A). In this manner, the surface 132 accommodates support of a human foot on the surface 124. In some implementations, the surface 132 can further include contours to further accommodate features of the human foot. For example, the surface 132 can include a recess to accommodate contours of the human anatomy such as an ankle bone.

The side walls 126, 128 and the perimeter walls 130*a*, 130*b* support the surface 124. In this manner, weight can be applied to the surface 124 without buckling or significant flexing of the protrusions 122. For example, a user of the seating device 100 can stand with both feet firmly supported on the protrusions 122, the weight of the standing user being supported by the seating device through the surface 124, the side walls 126, 128, the perimeter walls 130*a*, 130*b* and the wall 106.

In some implementations, the seating device 100 is used in an aquatic environment, such as a pool, lake, ocean, stream and river. For example, the seating device 100 can be submerged in a body of water with water entering the cavity 110 through the opening 108. As water flows into the cavity 110, air that is displaced by the water can exhaust from the cavity 110 through the holes 118. In this manner, substantially all of any gas within the cavity 110 can be exhausted from the cavity 110 to inhibit buoyancy of the seating device 100. In some implementations, the seating device may be partially submerged in the water, such that the cavity 110 includes air and water. In some examples, the seating device 100 is positioned against a floor such that base member 120 is in contact with the floor. For example, the seating device 100 can be positioned against a floor of a pool. A user can sit on the seating device 100, using the seating device 100 as an underwater stool, for example. The user can sit on the seat 112 and rest his/her feet on the protrusions 124.

In some implementations, the seating device 100 is formed of a non-corrosive material. Example materials can include plastic, thermoplastics, polymer, non-corrosive metals (e.g., stainless steel), and/or fiberglass. The seating device 100 can be formed from a plurality of materials. For example, the body 105 can be formed from a thermoplastic, while a weighted ring (e.g., weighting member 123 within cavity 121 (FIG. 6B)) can be formed of another, more dense material. The seating device 100 can be formed using a number of forming methods. Example forming methods include molding and extrusion.

Referring now to FIGS. 8-14 a table 800 will be described in detail. Although the illustrated implementation provides the table 800 as a round table, it is appreciated that the table can be of any geometric shaped. Example geometric shapes include round, square, rectangular, triangular, hexagonal, and octagonal. The table 800 includes a first side 802 and a second side 804 and a wall 806. The first side 802 includes a surface 808 having a center member 810 extending upward. The surface 808 is surrounded by an interior wall 812 and includes recesses 814 formed therein. The recesses 814 can be formed to accommodate one or more beverage containers. Example beverage containers include cans, glasses, cups, bottles and the like. Although not in the illustrated implementation, the table 800 can include other recesses formed therein to accommodate retention of any number of articles. Example articles can include tanning lotion containers, sun-screen containers, poker chips, playing cards, sunglasses and the like.

In some implementations, the wall 806 is sloped to provide a substantially conical shape to the table 800. The wall 806 is connected to the interior wall 812 via a surface 822. One or more notches 824 are formed into the walls 806, 812 and surface 822. In some implementations, a plurality of notches 824 can be provided. In some implementations, the notches 824 are symmetrically positioned about the table 800. In some implementations, the notches 824 include any geometric shape.

With particular reference to FIGS. 9-12 and 14, the table 800 further includes a connecting member 850. The connecting member 850 includes a hole 852 formed therethrough. The connecting member 850 and hole 852 enable the table to be anchored, as discussed in further detail below. In some implementations, a plurality of connecting members 850 can be provided, and can be symmetrically positioned about a bottom surface 854 of the table 800.

Figure 14:
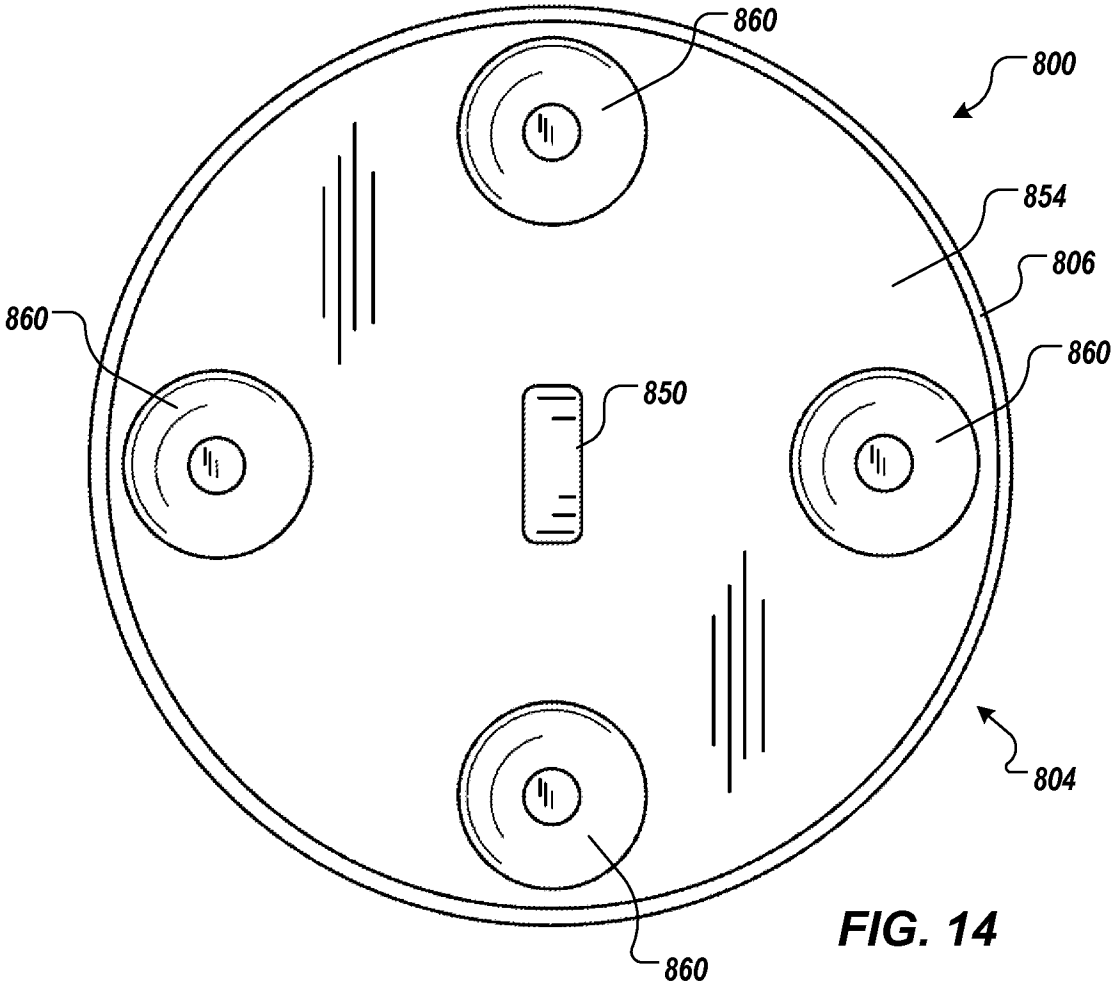
FIG. 14 is a bottom view of the table of FIG. 1.

With particular reference to FIG. 14, the bottom surface 854 of the table is shown in greater detail. In some implementations, the bottom surface 854 includes one or more recesses or dimples 860. In some implementations, the recesses 860 are symmetrically positioned about the bottom surface 854. In some implementations, the recesses 860 are positioned toward a periphery of the bottom surface 854. The recesses 860 can trap gas (e.g., air) below the table 800. In this manner, buoyancy of the table 800, discussed in further detail below, can be enhanced. Symmetric positioning of the recesses 860 about the bottom surface 854 evenly distributes the added buoyancy. Positioning of the recesses 860 toward the periphery of the bottom surface 854 enhances the stability of the table 800 as it floats on a fluid.

The table 800 is generally provided as a hollow body having a cavity (not shown) formed therein. The cavity is provided as a sealed cavity to prevent seepage of a liquid into the cavity. In this manner, the table 800 is buoyant and can float in a liquid environment. The table 800 can support objects on the surface 808, the center member 810, and/or in the recessed portions 814 above the liquid. Further, the table 800 can provide support to one or more persons. For example, a person can lean on the table 800 for support as the table 800 floats on the liquid. The notches 824 provide outlets for liquid to flow off of the table 800. For example, splashing or other aquatic activity may result in liquid encroaching on the table 800. The liquid can run off the table 800 through the notches 824. The table 800 can be anchored using a connector, such as a rope and/or chain. In particular, and as discussed in further detail below, a connector can be connected to the connecting member 850 and an anchor.

In some implementations, the table 800 is formed of a non-corrosive material. Example materials can include plastic, thermoplastics, polymer, non-corrosive metals (e.g., stainless steel), and/or fiberglass. The table 800 can be formed from a plurality of materials, and/or can be formed from a plurality of combined components. The table 800 can be formed using a number of forming methods. Example forming methods include molding and extrusion.

Figure 15:
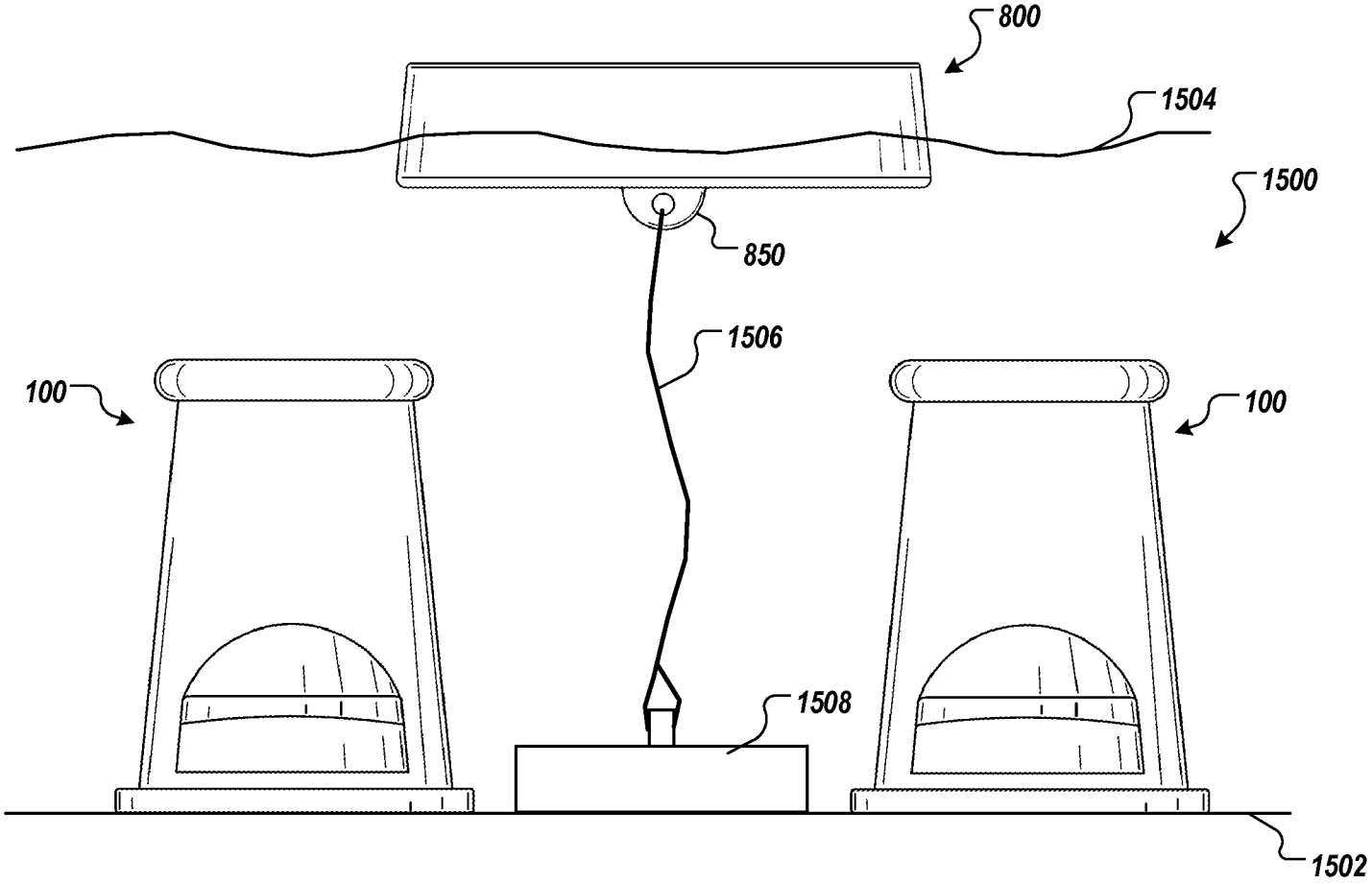
FIG. 15 depicts an aquatic environment including seating devices and a table in accordance with implementations of the present disclosure.

FIG. 15 illustrates an aquatic environment 1500 that includes a floor 1502 and a liquid 1504. For example, the aquatic environment 1500 can include a pool. A pair of seating devices 100 are submerged in the liquid 1504 and rest on the floor 1502. A table 800 floats on the liquid 1504. In the illustrated implementation, the table 800 is partially submerged in the liquid 1504. The table 800 is anchored to a ballast 1506 via a connector 1506. The connector 1506 can include a rope and/or chain, and the ballast 1508 is provided as a weight that sinks in the liquid 1504 and that rests on the floor 1502.

A number of implementations of the present disclosure have been described. Nevertheless, it will be understood that various modifications may be made without departing from the spirit and scope of the present disclosure. Accordingly, other implementations are within the scope of the following claims.

What is claimed is:

1. A seating device for use in a liquid, comprising:

a body having a closed first end, an open second end such that the body defines an end cavity disposed about a periphery of the open second end, a wall running between the closed first end and the open second end, and a weight comprising a weighting material disposed within the end cavity that results in a center-of-gravity being located between the open second end and a geometric center of the seating device, the geometric center being located between the closed first end and the open second end, the closed first end and the wall defining a cavity that is accessible through the open second end, the closed first end defining a seating surface having one or more holes formed therethrough, the one or more holes enabling flow of a fluid therethrough as the seating device is submerged in the liquid.

2. The seating device of claim 1, wherein the weighting material comprises stainless steel.

3. The seating device of claim 1, wherein the seating surface is contoured.

4. The seating device of claim 1, wherein the closed first end defines a first diameter and the open second end defines a second diameter, the first diameter being at most equal to the second diameter.

5. The seating device of claim 1, wherein the body comprises first and second foot rests integrally formed therein, each of the first and second footrests comprising a surface for supporting a foot.

6. The seating device of claim 5, wherein the surface is a textured surface.

7. The seating device of claim 1, wherein the wall comprises a contoured surface, the contoured surface comprising a contour that accommodates human anatomical features.

8. The seating device of claim 7, wherein the human anatomical features comprises features associated with a human foot and/or ankle.

* * * * *